US006270032B1

(12) United States Patent
Chen

(10) Patent No.: US 6,270,032 B1
(45) Date of Patent: Aug. 7, 2001

(54) VARIABLE OR STEADY YARN FEEDING APPARATUS

(76) Inventor: Jen Hui Chen, No. 775, Chung Cheng Rd., Su-Lin City, Taipei County (TW)

( * ) Notice: Subject to any disclaimer, the term of this patent is extended or adjusted under 35 U.S.C. 154(b) by 0 days.

(21) Appl. No.: 09/315,813

(22) Filed: May 21, 1999

(30) Foreign Application Priority Data

Apr. 3, 1999 (TW) ..... 088205155

(51) Int. Cl.[7] ..... B65H 51/02

(52) U.S. Cl. ..... 242/365.6; 242/364.5; 66/132 R

(58) Field of Search ..... 242/364.5, 365.9, 242/366, 366.1, 365.6; 66/132 T, 132 R

(56) References Cited

U.S. PATENT DOCUMENTS

| | | | | |
|---|---|---|---|---|
| 3,606,975 | | 9/1971 | Rosen . | |
| 3,908,921 | * | 9/1975 | Jacobsson | 242/364.5 |
| 4,106,713 | * | 8/1978 | Jacobsson | 242/364.5 |
| 4,271,687 | * | 6/1981 | Memminger et al. | 242/364.5 |
| 4,890,464 | | 1/1990 | Tsuchiya et al. | 66/132 T |
| 5,388,747 | * | 2/1995 | Chen | 66/132 R |
| 5,669,245 | * | 9/1997 | Shieh | 242/365.6 |
| 5,740,974 | * | 4/1998 | Conzelmann | 242/364.5 |
| 6,079,234 | * | 6/2000 | Hsiung | 66/132 R |

* cited by examiner

*Primary Examiner*—Emmanuel M. Marcelo
(74) *Attorney, Agent, or Firm*—Dougherty & Troxell

(57) ABSTRACT

A variable or steady yarn feeding apparatus comprises a first yarn brake; a support; a steady yarn supply drum for plain knitting; a variable yarn supply drum having a high friction resilient V-shaped or U-shaped surface, the drums both driven by a drive device; a yarn guide device for guiding the yarn from the variable yarn supply drum to the steady yarn supply drum; a self-adjustable yarn guide device provided below the support; and a second yarn brake for adjusting the yarn feed of the variable yarn supply drum. An end of the self-adjustable yarn guide device is away from the variable yarn supply drum in a no demand condition by an expansion of a spring provided therein, while the end is in contact with the surfaces of the variable yarn supply drum when there is a yarn demand. A jacquard knitting is made possible by the cooperation of the second yarn brake with the variable yarn supply drum.

5 Claims, 6 Drawing Sheets

VARIABLE OR STEADY YARN FEEDING APPARATUS

BACKGROUND OF THE INVENTION

1. Field of the Invention

The present invention relates to a variable or steady yarn feeding apparatus, and more particularly to a yarn feeding apparatus of a circular knitting machine having a variable or a steady yarn feeding features.

2. Description of Related Art

Recently, fabric, knitted by a circular knitting machine, has a variety of styles.

It is required to have a variable yarn feed or to have a steady yarn feed in order to select to knit a variety of fabrics by configuring the yarn into a number of different tension yarns or a steady yarn feeding during the knitting process. As such, a yarn feeding apparatus having a variable yarn feed or having a steady yarn feed features is desirable.

For example, a U.S. Pat. No. 4,890,464 entitled "POSITIVE FEEDING DEVICE FOR CIRCULAR KNITTING MACHINE" is provided to accomplish such goal. The device comprises a yarn feeding mechanism, driven by a drive means, having a first yarn brake surface and a second yarn guide surface. A yarn lead-in side of the first yarn brake surface has a first yarn brake device provided, and a yarn lead-in side of the second yarn guide surface has a second yarn guide device provided respectively.

The patent 4,890,464 is characterized in that the friction between the yarn and the first yarn brake surface is larger than that between the yarn and the second yarn guide surface. As such, the yarn is fed through the second yarn guide surface for a plain knitting when the yarn feed is steady, while the yarn is fed through the first yarn brake surface for a jacquard knitting when the yarn feed is variable. As a result, a yarn feed apparatus having a variable yarn feed and a steady yarn feed features is provided.

However, the prior art is unsatisfactory for the following reason. As to the first yarn brake surface, whether the yarn fed or not is determined by the friction between the yarn and the resilient surface as well as the tension of the yarn demand. As such, a maximum contact area between the yarn and the resilient surface is desirable for fulfilling the purpose of a large demand. In contrast, a minimum contact area (or even no contact) between the yarn and the resilient surface is desirable when there is no demand for avoiding yarn feed. Note that the contact angle or area between the yarn and the resilient surface is adjustable only by rotating the position of the first yarn brake device. It is claimed that the contact angle or area between the yarn and the resilient surface is adjustable by changing the position of the first yarn brake device through a manual operation.

However, in fact, it is impossible for an operator to instantly and accurately adjust the position of the first yarn brake device during the knitting process if there is a sudden change of yarn demand. Accordingly, in practice, the first yarn brake device is pre-set to an intermediate position, i.e., an angle between the yarn and the resilient surface is between the maximum yarn feed (i.e., a maximum contact angle between the yarn and the resilient surface) and no feeding (i.e., no contact or a minimum contact angle). As such, a high rate of fabric fault occurs if the first yarn brake device is not adjusted to an optimum position and/or the quality of the yarn is poor. In detail, it is possible for the feeding quantity of yarn being not sufficient to the demand due to a small friction between the yarn and the resilient surface. Further, it is possible for a continuous yarn feed even if there is no demand due to a high friction between the yarn and the resilient surface. As a result, a poor fabric such as irregularity will be knitted.

Additional prior art, a preferred embodiment of variable feeding device, is disclosed in U.S. Pat. No. 3,606,975 entitled "METHOD OF FEEDING YARN TO A KNITTING PLACE ON A TEXTILE MACHINE". The U.S. Pat. No. 3,606,975 is embodied in a SFT storage feeder manufactured by a German-based company Memminger-iro. The feeder is characterized in that the yarn feed speed is controlled by a detection circuit of the tension loop. Generally, the precision of an electronically controlled device is very high. However, the speed control of the motor is sometimes interfered by the environment when the yarn consumption is intermittent. Further, the knitting machine owner is mostly bothered by the unacceptable high fault rate of the tension loop being in contact with the yarn frequently. Furthermore, it is required to replace the tension loop whenever there is a change in the yarn feed. As such, a frequent change of the tension loop and/or the tension loop adjustment is inevitable for knitting a variety of fabrics. This is a time-consuming process as well as a possible damage to the tension loop caused by such replacement. These drawbacks have not been solved in a knitting machine controlled by a microcomputer.

Thus, a need exists to provide a variable or steady yarn feeding apparatus in order to overcome the above drawbacks of the prior art.

SUMMARY OF THE INVENTION

It is an object of the present invention to provide a variable or steady yarn feeding apparatus for achieving the purposes of jacquard knitting or plain knitting as well as instantly and accurately adjusting the yarn feed speed based on demand.

It is another object of the present invention to provide a variable or steady yarn feeding apparatus wherein a high friction resilient yarn guide surface having a V-shaped or U-shaped section is provided on a variable yarn supply drum. It is contemplated that the drawbacks of prior art such as yarn slipped on the resilient surface and yarn fault occurred on a high speed yarn feed are eliminated such that an improvement of yarn quality is realized.

It is a further object of the present invention to provide a variable or steady yarn feeding apparatus wherein a self-adjustable yarn guide means is provided on the outgoing yarn path. The pivot angle is self-adjusted by the yarn rate based on the tension requirement. By the guiding of the self-adjustable yarn guide means, the yarn will not be in contact with the resilient surface of the yarn supply drum when there is no demand, while the yarn will be completely in contact with the resilient surface of the yarn supply drum when there is a high demand. As a result, a feeding and a no feeding conditions are obtained in order to further improve the quality of the yarn.

It is a further object of the present invention to provide a variable or steady yarn feeding apparatus wherein a tension adjustable yarn brake is provided on the outgoing yarn path. It is contemplated that the frequent replacement of the tension loop occurred in the prior art is eliminated in the present invention.

To achieve the above and other objects, there is provided a variable or steady yarn feeding apparatus comprising a first adjustable yarn brake means for controlling the tension of the lead-in yarn and detecting a break thereof; a variable yarn supply drum; a steady yarn supply drum; a drive means for driving the drums which further rotated by means of a number of belts in a multiple speed arrangement; a support; a yarn guide means secured onto the support having a plurality of eyes provided thereon for guiding the yarn from the variable yarn supply drum to the steady yarn supply drum; a self-adjustable yarn guide means provided below the support and positioned adjacent to the variable yarn supply drum by a predetermined distance; and a second adjustable yarn brake means for adjusting the yarn feed of the variable yarn supply drum.

The variable or steady yarn feeding apparatus is further characterized in that the variable yarn supply drum is a light metal material made as a whole. The variable yarn supply drum is a cylindrical body having a V-shaped or U-shaped surface provided on the circumference. A high friction resilient layer is provided on the V-shaped or U-shaped surface and thus the yarn is able to be tightly wound thereon. A free end of the self-adjustable yarn guide means is away from the variable yarn supply drum when there is no demand by the expansion of the spring provided therein, i.e., by the guiding of the self-adjustable yarn guide means, the yarn will not be in contact with the resilient surface of the variable yarn supply drum when there is no demand, while the yarn will be completely in contact with the resilient surface of the variable yarn supply drum when there is a high demand because the yarn tension is strong enough to compress the spring to bring the free end of the self-adjustable yarn guide means closer to the variable yarn supply drum to cause a maximum contact angle between the yarn and the variable yarn supply drum. As a result, a feeding and a no feeding conditions are obtained.

The variable or steady yarn feeding apparatus is further characterized in that the yarn tension is adjustable by the second yarn brake means when a plurality of different yarns having different tensions are knitted and thus a jacquard knitting is made possible.

The variable or steady yarn feeding apparatus is further characterized in that it is simply required to wind the yarn a few times on the steady yarn supply drum in order to change from a variable yarn feed to a steady yarn feed and thus the tedious process of yarn rearrangement of prior art is eliminated.

The above and other objects, features and advantages of the present invention will become apparent from the following detailed description taken with the accompanying drawings.

DETAILED DESCRIPTION OF THE PREFERRED EMBODIMENTS

Figure 1:
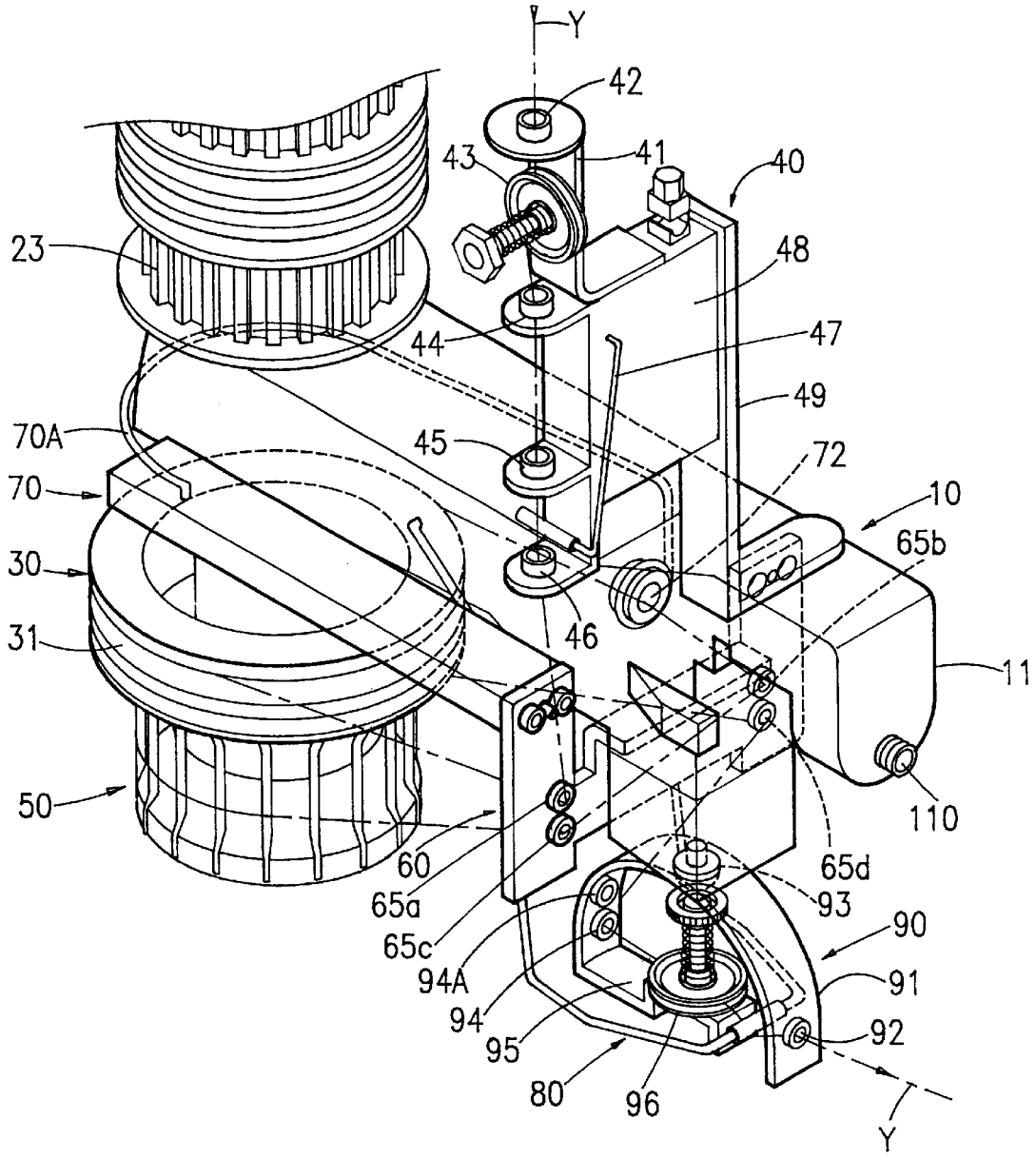
FIG. 1 is a perspective view of the variable or steady yarn feeding apparatus of the present invention.
Figure 2:
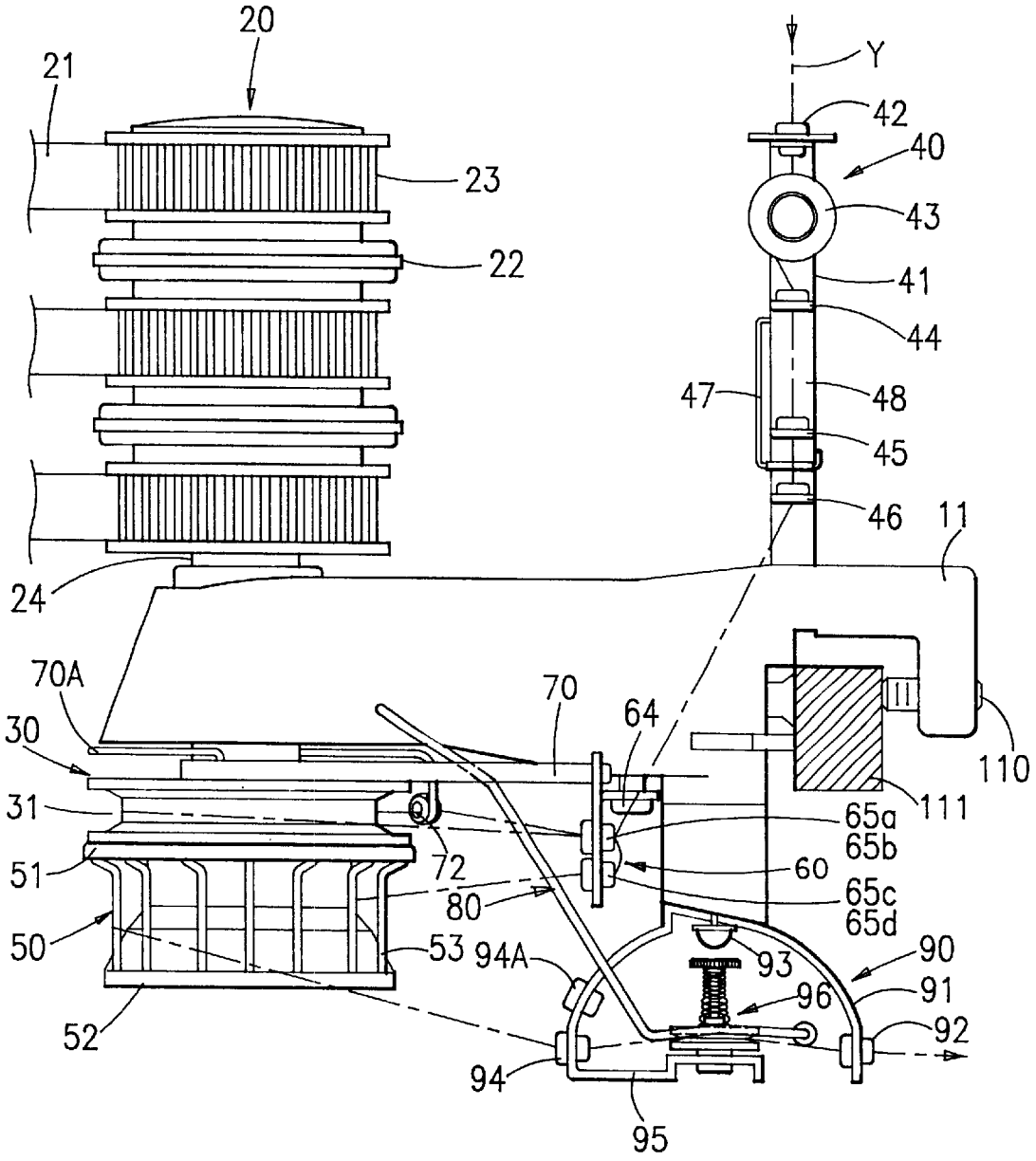
FIG. 2 is a front side view of FIG. 1 when the variable or steady yarn feeding apparatus is in a variable yarn feed process.

Referring to FIGS. 1–2, there is shown a variable or steady yarn feeding apparatus of the invention. The apparatus comprises a support 10, a drive device 20, a variable yarn supply drum 30, a first adjustable yarn brake device 40, a steady yarn supply drum 50, a yarn guide means 60, a self-adjustable yarn guide means 70 positioned above the variable yarn supply drum 30, a tension controller 80, and a second adjustable yarn brake device 90 wherein a fixer means 11 is provided on an end of the support 10 for being threadedly secured to a support ring 111 by a screw 110; the first adjustable yarn brake device 40 provided on the top of the support 10 including a yarn brake 48 secured on the support 10 by an L-shaped member 41, a yarn guide eye 42 and a first disk tension device 43 provided on the top and the center of the L-shaped member 41 respectively, a top, a center, and a bottom yarn guide eyes 44, 45, and 46 provided on a side of the yarn brake 48, and a tension arm 47.

The second adjustable yarn brake device 90 includes a C-shaped member 91 secured to the support 10 by a screw 93, and an eye 92 provided on one end and a pair of eyes 94 and 94A provided on the other end thereof, a horizontally positioned plate 95 having one end attached to the C-shaped plate member 91 and the other end free, a second disk tension device 96 provided on the plate 95 in which the eye 94 is used for the passing through of yarn with high tension, while the eye 94A is used for the passing through of yarn with low tension. In detail, it is designed to allow the yarn with low tension to pass from the eye 94A to the eye 92 directly without passing through the second disk tension device 96.

The construction and operation of the yarn supply drums 30 and 50 and the drive device 20 are described below:

The drive device 20, provided on the top of the support 10, comprises a drive shaft 24, a number of belts 21, a corresponding number of pulleys 23 being driven by a drive source (not shown) over the belts 21, and a clutch 22 positioned between two adjacent pulleys 23 for providing a desirable rotation speed of the drive shaft 24 and the pulleys 23. The drive shaft 24 is extended downwardly through the support 10 to be attached to the variable yarn supply drum 30 and the steady yarn supply drum 50. A V-shaped or U-shaped surface 31 is provided on the variable yarn supply drum 30. The surface 31 is preferably made of synthetic rubber or silicone rubber for allowing the yarn being tightly wound thereon. The rotation speeds of the pulleys 23, the variable yarn supply drum 30, and the steady yarn supply drum 50 are identical because the pulleys 23, the variable yarn supply drum 30, and the steady yarn supply drum 50 are driven by the same drive shaft 24. The yarn guide means 60 functions as guiding the yarn Y from the variable yarn supply drum 30 to a knitting machine (not shown). The yarn guide means 60 is threadedly secured onto the bottom of the support 10 by means of a bolt 64. A plurality of eyes 65*a*–65*d* are provided on the yarn guide means 60 each adapted to guide the yarn Y to a desirable direction such as guiding the yarn Y to or from the variable yarn supply drum 30 as well as guiding the yarn Y to or from the steady yarn supply drum 50.

A variable yarn feed process for jacquard knitting is illustrated below. The yarn Y is guided from the yarn guide eye 42, through the first disk tension device 43, the top, the center, and the bottom yarn guide eyes 44, 45, and 46, the tension arm 47, the eye 65*a* of the yarn guide means 60, wrapped around the surfaces 31 of the variable yarn supply drum 30, an eye 72 of the self-adjustable yarn guide means 70, the eye 65*b* and the eye 65*c* of the yarn guide means 60, tangentially on the outer surface of the steady yarn supply drum 50, the eye 65*d* of the yarn guide means 60, the eye 94, the second disk tension device 96, the eye 92, and finally to a knitting machine (not shown).

Figure 3:
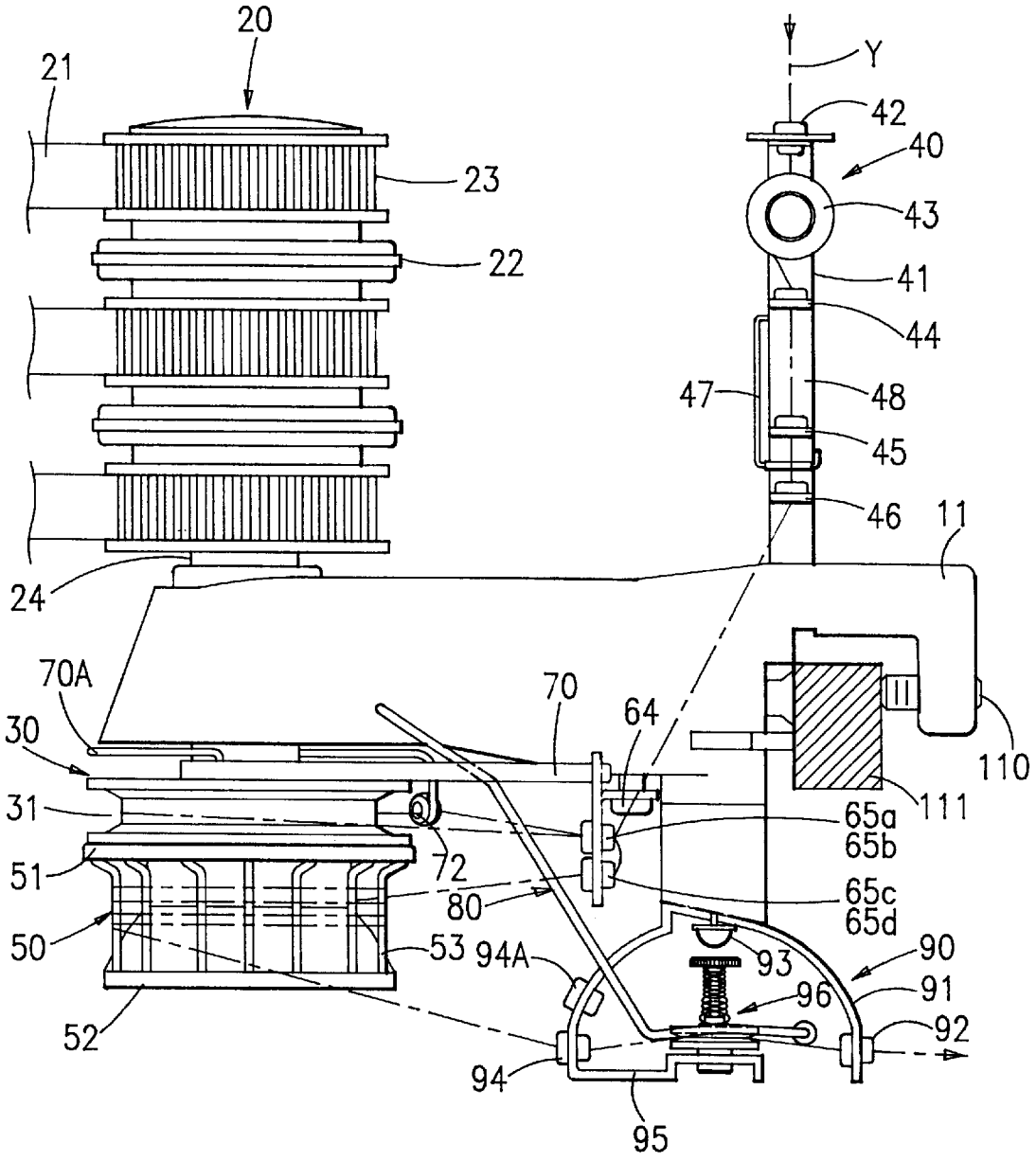
FIG. 3 is a front side view of FIG. 1 when the variable or steady yarn feeding apparatus is in a steady yarn feed process.
Figure 4:
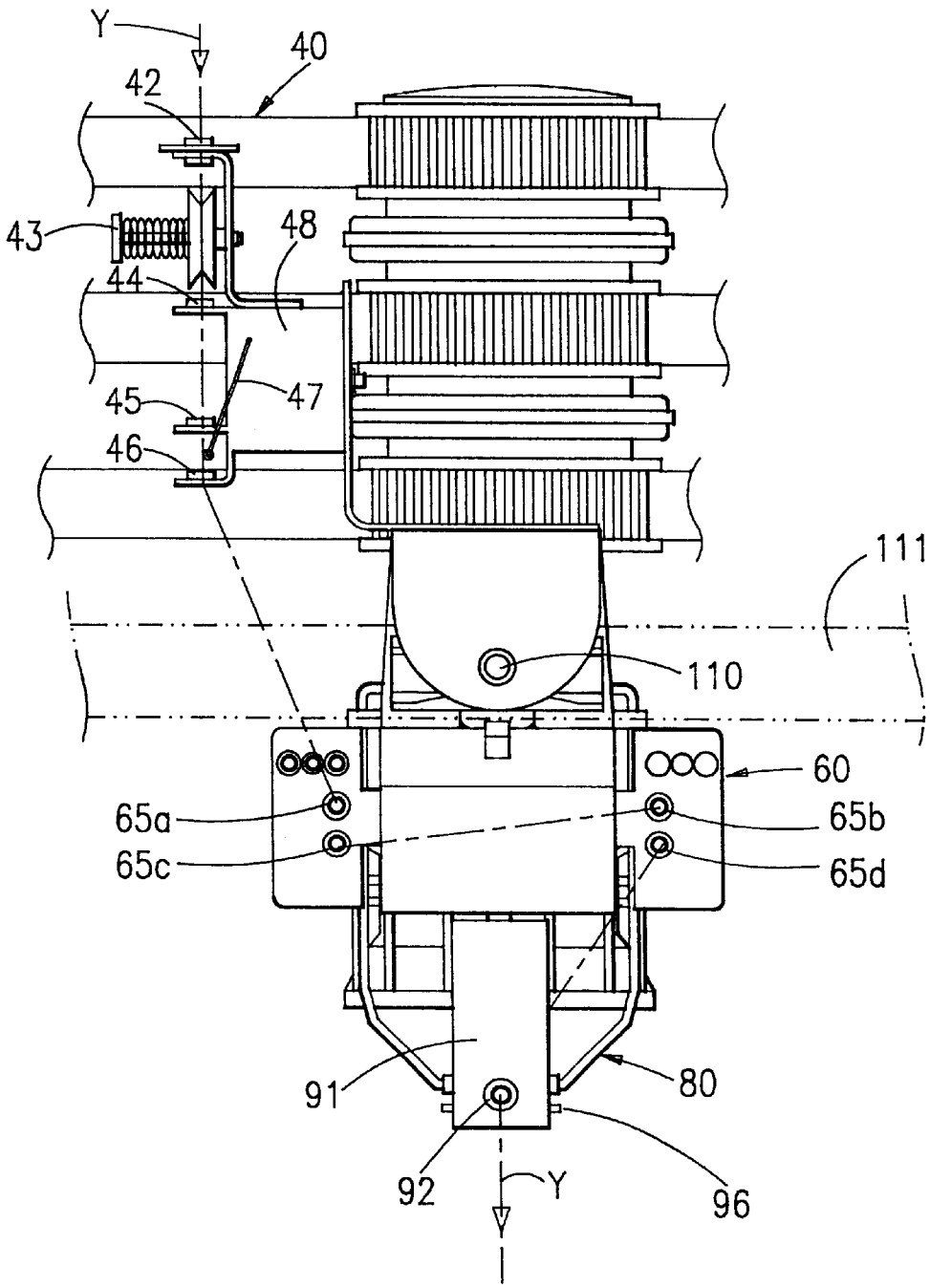
FIG. 4 is a right side view of FIG. 1.

As shown in FIGS. 3–4, a steady yarn feed process for plain knitting is illustrated. The yarn Y is guided from the yarn guide eye 42, through the first disk tension device 43, the top, the center, and the bottom yarn guide eyes 44, 45, and 46, the tension arm 47, the eyes 65*a*–65*d*, the variable yarn supply drum 30, wrapped around the outer surface of the steady yarn supply drum 50 eight to ten times, the eye 94, the second disk tension device 96, the eye 92, and finally to a knitting machine (not shown). Alternatively, as stated above, the yarn Y coming from the steady yarn supply drum 50 is guided through the eye 94A to the eye 92 directly without passing through the second disk tension device 96 before finally directed to a knitting machine (not shown).

Figure 5:
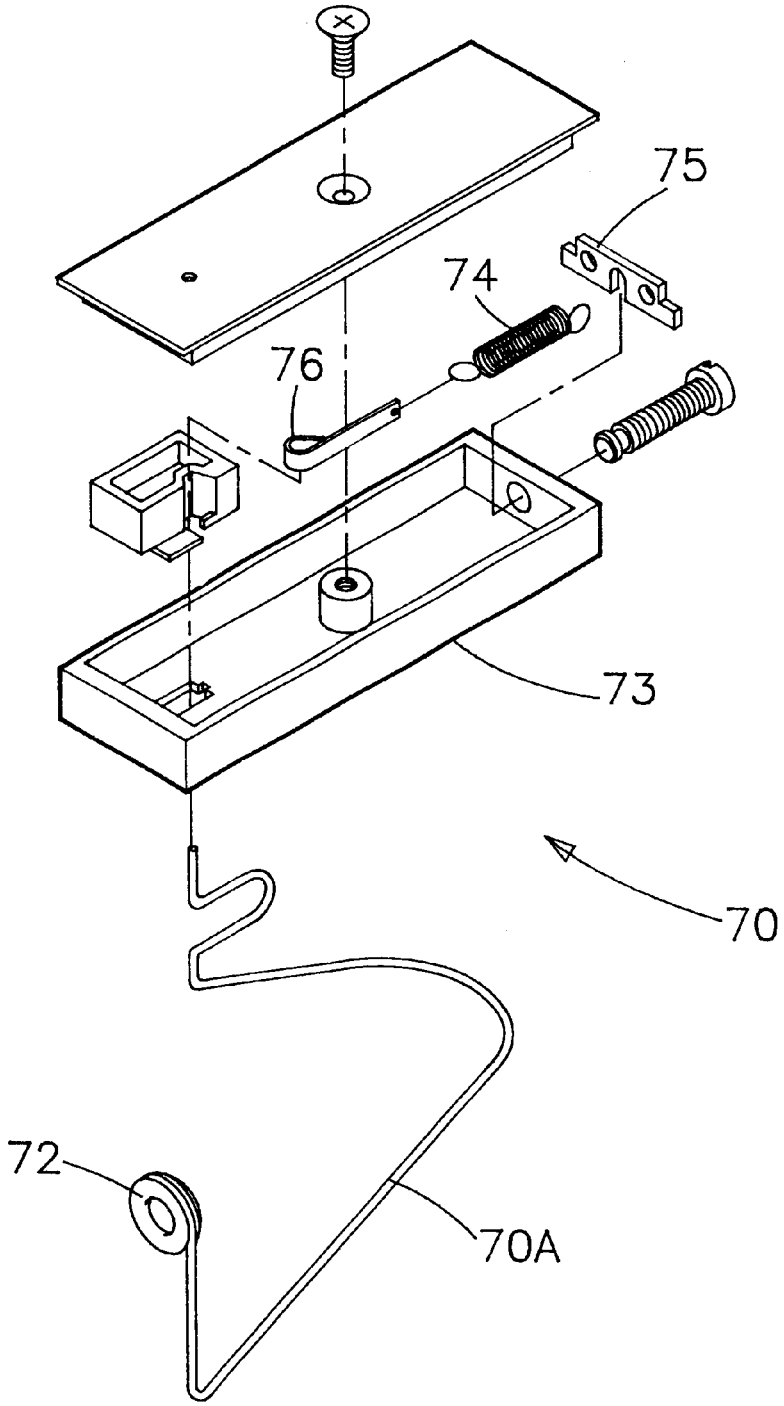
FIG. 5 is an exploded view of the self-adjustable yarn guide means of the steady and variable yarn feed apparatus.
Figure 6:
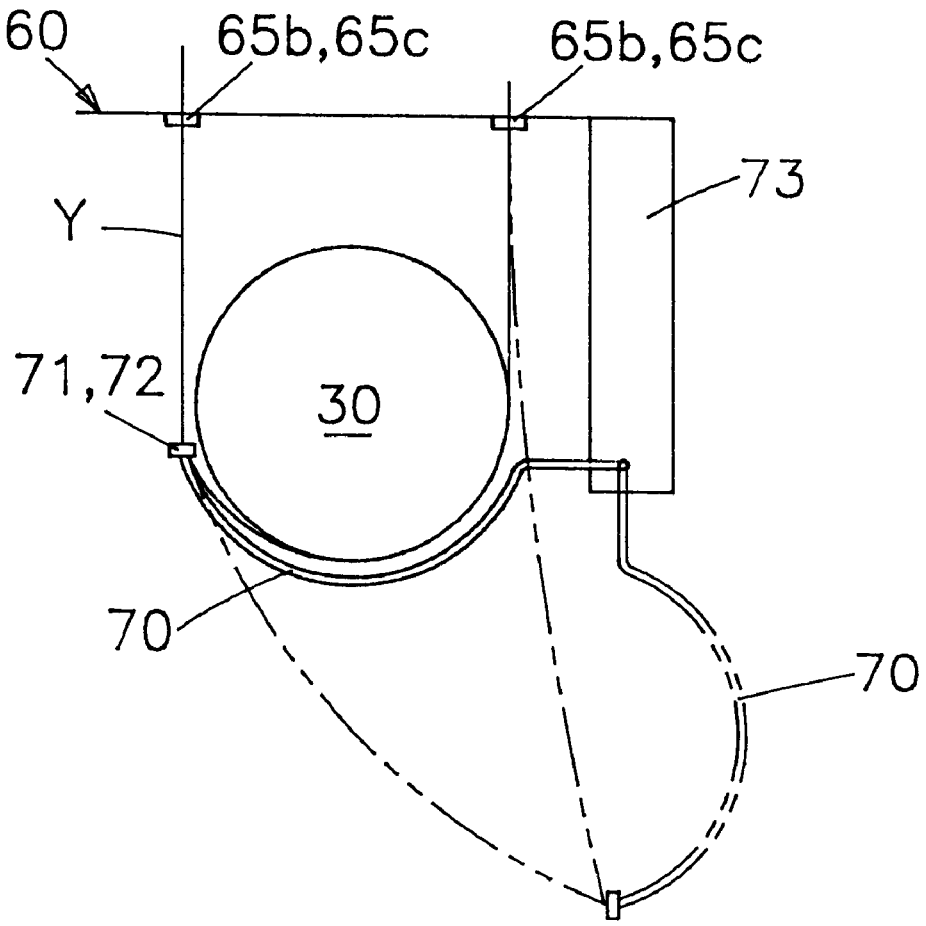
FIG. 6 is a schematic diagram illustrating the self-adjustable yarn guide means in cooperation with the variable yarn supply drum.

As shown in FIGS. 5–6, the components and operation of the self-adjustable yarn guide means 70 are illustrated. The self-adjustable yarn guide means 70 is designed to operate based on the yarn tension requirement. One end of the self-adjustable yarn guide means 70 is pivoted within a body 73, while the other end of the self-adjustable yarn guide means 70 is a free end having an eye 72 corresponding to the yarn guide surface 31 of the variable yarn supply drum 30. A spring 74 is provided within the body 73. One end of the spring 74 is secured on the body 73 or a detachable base member 75, while the other end of the spring 74 is secured on a hook-shaped member 76. The free end of the self-adjustable yarn guide means 70 is away from the variable yarn supply drum 30 in a little or no demand condition because the expansion of the spring 74 as indicated by the broken line in FIG. 6, i.e., the yarn Y will not be in contact with the outer surface 31 of the variable yarn supply drum 30, while the yarn Y will be completely in contact with the outer surface 31 of the variable yarn supply drum 30 when there is a high demand because the yarn tension is strong enough to compress the spring 74 to bring a yarn guide arm 70A of the self-adjustable yarn guide means 70 closer to the variable yarn supply drum 30 to cause a maximum contact angle between the yarn Y and the surfaces 31 of the variable yarn supply drum 30 as indicated by line in FIG. 6.

While the invention herein disclosed has been described by means of specific embodiments, numerous modifications and variations could be made thereto by those skilled in the art without departing from the scope of the invention set forth in the claims.

What is claimed is:

1. A variable or steady yarn feeding apparatus comprising:

a support threadedly secured on a knitting machine;

a drive means provided the support driven by a plurality of belts;

a first adjustable yarn brake means having a disk tension means and a detecting arm provided on a lead-in yarn path for controlling a yarn tension and detecting a break thereof;

a variable yarn supply drum driven by the drive means having a high friction resilient yarn guide surface;

a steady yarn supply drum provided below the variable yarn supply drum driven by the drive means having a low friction yarn guide surface;

a yarn guide means having a plurality of eyes provided thereon for guiding the yarn from the variable yarn supply drum to the steady yarn supply drum;

a self-adjustable yarn guide means including a movable arm having one end pivotedly mounted on the self-adjustable yarn guide means, and a guide eye provided on the other free end, the self-adjustable yarn guide means provided below the support and positioned adjacent to the variable yarn supply drum by a predetermined distance, the free end of the movable arm of the self-adjustable yarn guide means is away from the variable yarn supply drum in a no demand condition by an expansion of a spring provided therein, while the free end of the movable arm of the self-adjustable yarn guide means is in contact with the surface of the variable yarn supply drum when there is a yarn demand; and a second adjustable yarn brake provided on an end of a pay-out yarn path for adjusting the yarn tension when a plurality of different yarns having different tensions are knitted.

2. The apparatus of claim 1, wherein the yarn guide surface of the variable yarn supply is a U-shaped or V-shaped section.

3. The apparatus of claim 1, wherein a top of the yarn guide means is secured onto a bottom of the support.

4. The apparatus of claim 1, wherein the yarn guide surface of the variable yarn supply is made of synthetic rubber.

5. The apparatus of claim 1, wherein the yarn guide surface of the variable yarn supply is made of silicone rubber.

* * * * *